US005333641A

United States Patent [19]

Cota et al.

[11] Patent Number: 5,333,641

[45] Date of Patent: Aug. 2, 1994

[54] CONTAINMENT VESSEL FOR ENVIRONMENTALLY SEALING A CHEMICAL COMPOUND

[75] Inventors: Marlo E. Cota; Richard L. Johnson, both of Scottsdale, Ariz.

[73] Assignee: Motorola, Inc., Schaumburg, Ill.

[21] Appl. No.: 160,763

[22] Filed: Dec. 3, 1993

[51] Int. Cl.[5] ..... B65D 90/24

[52] U.S. Cl. ..... 137/264; 137/312; 220/426

[58] Field of Search ..... 137/264, 312; 220/426

[56] References Cited

U.S. PATENT DOCUMENTS

| | | | |
|---|---|---|---|
| 3,110,157 | 11/1963 | Radd | 220/426 X |
| 3,135,420 | 6/1964 | Farrell et al. | 220/426 |
| 3,658,080 | 4/1972 | Mitchell | 137/264 X |
| 3,827,455 | 8/1974 | Lee | 137/264 X |
| 4,871,087 | 10/1989 | Johnson | 220/426 X |
| 5,086,804 | 2/1992 | Ngai | 137/312 |
| 5,284,175 | 2/1994 | Mykytyn | 137/312 |

*Primary Examiner*—John Rivell
*Attorney, Agent, or Firm*—Robert D. Atkins

[57] ABSTRACT

A chemical containment vessel provides an environmental seal around a bottle containing hazardous chemicals for use in manufacturing processes. An enclosure vessel is made of upper and lower assemblies connected together to form a cavity for housing the bottle. A gasket between the upper and lower assemblies provides the environmental seal for the containment vessel. The inner conduits of first and second coaxial conduits are coupled to the inlet and outlet of the bottle for transporting the hazardous chemical to a reaction chamber. The outer conduits of the first and second coaxial conduits are connected to the cavity to nitrogen purge any chemical compound escaping from the bottle into the cavity. The escaping hazardous chemical can be detected and removed in a safe manner.

19 Claims, 1 Drawing Sheet

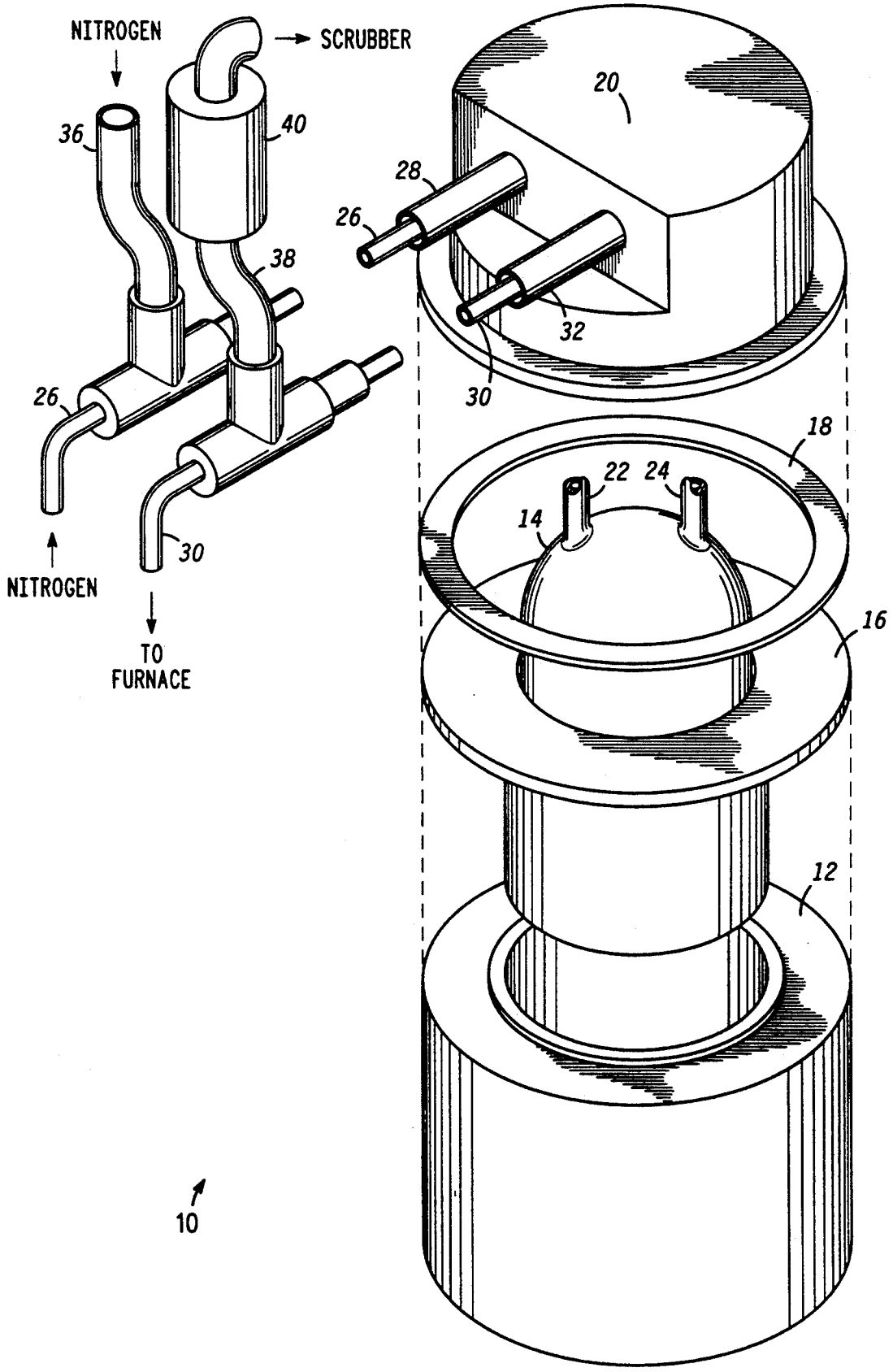
NITROGEN
SCRUBBER
36
40
38
26
30
NITROGEN
TO FURNACE
20
28
26
32
30
18
22
24
14
16
12
10

CONTAINMENT VESSEL FOR ENVIRONMENTALLY SEALING A CHEMICAL COMPOUND

BACKGROUND OF THE INVENTION

The present invention relates in general to containment vessels and, more particularly, to an environmentally sealed containment vessel.

Most if not all semiconductor manufacturing processes use chemicals in one form or another. Some of the chemicals, for example those identified as chlorofluorocarbons (CFC), have been found to be environmentally hazardous by the Environmental Protection Agency (EPA). The CFC compounds contain carbon along with fluorine and/or chlorine and possess the undesirable side-effect of depleting the ozone layer when released into the atmosphere. The ozone layer provides a shield for the earth's surface against harmful solar radiation Some CFC chemical compounds play an important role in the manufacturing processes of semiconductors. For example, TCA (1, 1, 1 trichloroethane) has been widely used in diffusion processing as a gettering agent for trapping heavy metal ions. TCA is on the EPA's list of ozone depleting chemicals. Environmentally responsible companies and individuals have conducted research to find substitute chemicals that would satisfy the same process needs and yet not cause depletion of the ozone layer. The chemical compound 1,1 dichloroethylene (DCE) has meet that goal. However, a safety issue arises with the storage and use of DCE in that its flash point of 43° F. makes it a potential fire hazard.

Hence, a need exists to safely contain hazardous chemical compounds while in storage for use in manufacturing processes.

BRIEF DESCRIPTION OF THE DRAWING

The sole figure illustrates a chemical containment vessel.

DETAILED DESCRIPTION OF THE PREFERRED EMBODIMENT

A containment vessel 10 is shown in the sole figure comprising lower half assembly 16 and upper half assembly 20 connected together forming a cavity with gasket 18 placed between the assemblies. Lower half assembly 16 and upper half assembly 20 may be attached together with bolts, rivets, or any other attachment technique to make an environmentally sealed enclosure and house bottle 14. Assembly 20 may be constructed with a removable lid (not shown) to allow installation and removal of bottle 14. Alternately, assemblies 16 and 20 may be disassembled to permit installation and removal of bottle 14.

A quartz bottle 14 containing a chemical compound, e.g. 1,1 dichloroethylene (DCE), is placed in the cavity of containment vessel 10. DCE is commonly used to clean diffusion furnaces (not shown) in semiconductor processes. The chemical compound stored in bottle 14 may have undesirable properties, e.g. toxic, flammable, corrosive, irritating or in any way environmentally polluting, and therefore must be isolated from the environment for personal and public safety.

Containment vessel 10 rests partially inside temperature control unit 12 which maintains the temperature and vapor pressure of the chemical compound inside bottle 14 at appropriate levels. The chemical compound must be maintained at the proper temperature for the chemical process in the diffusion furnace. Furthermore, the cavity of containment vessel 10 must be environmentally controlled in order maintain acceptably safe storage of the chemical compound in bottle 14.

Containment vessel 10 is constructed of a chemically unreactive material, e.g. polyethylene, that is compatible with the chemical compound in bottle 14. The material possesses optical properties that permits the use of photo-optical liquid level detection without invading the controlled environment within containment vessel 10. The material further possesses thermal properties to permit the temperature of the chemical compound in bottle 14 to be maintained at a temperature dictated by the process.

A first coaxial conduit connected to containment vessel 10 has an inner conduit 26 and an outer conduit 28. The inner conduit 26 is connected by way of a first valve and coupling (not shown) to conduit 22 at an inlet of bottle 14. A second coaxial conduit has an inner conduit 30 and an outer conduit 32. The inner conduit 30 is connected by way of a second valve and coupling (not shown) to conduit 24 at an outlet of bottle 14. Bottle 14 may be refilled as necessary through the first and second valves. The inner conduit 26 carries a gas, e.g. nitrogen, to bottle 14 in order to force the chemical compound through inner conduit 30 to the diffusion furnace chamber for the desired chemical reaction. The outer conduits 28 and 32 connect to the inner cavity of containment vessel 10 and function together to allow a gas or liquid purge of the internal environment. The gas purge through conduits 28 and 32 may be nitrogen. The outer conduits 28 and 32 provide safety and double containment of the chemical compound as it flows from bottle 14 to the diffusion furnace.

The nitrogen gas purge enters conduit 36 and flows into conduit 28 to intermix with the controlled environment within the cavity of containment vessel 10. The nitrogen purge flows out conduit 32 and through conduit 38 where monitor station 40 detects predetermined levels of any toxic, flammable, corrosive, irritating or environmentally polluting compound. Any DCE leakage into the cavity of containment vessel 10 from a failed seal of bottle 14 flows through conduit 38 where it is detected so that an operator may respond and correct the faulty seal of bottle 14. Alternately, the nitrogen purge provides a convenient method of diluting and/or removing any vapors or escaping chemical from bottle 14. The diluted vapors and/or chemical can be transported through conduit 38 to an appropriate treatment facility, e.g. scrubber (not shown).

Thus, a key feature of the present invention is to contain and/or disperse any hazardous chemical compound that escapes from bottle 14 and thereby avoid damaging the environment or otherwise prevent an unsafe condition. It is important to prevent the possibility of combustion of the chemical compound. The bottle containing the hazardous chemical is environmentally sealed with separate conduits for transporting the chemical compound and for purging the controlled environment of the containment vessel. Any leaks may be detected and properly handled.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention.

What is claimed is:

1. A containment vessel, comprising:

a bottle containing a chemical compound, said bottle having an inlet and an outlet;

an enclosure vessel forming a cavity for housing said bottle and providing an environmental seal of said bottle; and first and second coaxial conduits having an inner and an outer conduit, said inner conduits of said first and second coaxial conduits being coupled to said inlet and outlet of said bottle respectively for transporting said chemical compound, said outer conduits of said first and second coaxial conduits being connected to said cavity to purge any of said chemical compound that may escape from said bottle into said cavity.

2. The containment vessel of claim 1 wherein said enclosure vessel includes:

a lower half assembly;

an upper half assembly connected to said lower half assembly to form said cavity; and a gasket separating said lower half assembly and said upper half assembly to form said environmental seal of said cavity.

3. The containment vessel of claim 2 wherein said enclosure vessel is made of a chemically unreactive material.

4. The containment vessel of claim 3 wherein said enclosure vessel is made of polyethylene.

5. The containment vessel of claim 4 wherein said chemical compound is 1,1 dichloroethylene.

6. The containment vessel of claim 5 wherein said outer conduit of said first coaxial conduit receives a first nitrogen purge from a first conduit.

7. The containment vessel of claim 6 wherein said outer conduit of said second coaxial conduit returns said first nitrogen purge to a second conduit.

8. The containment vessel of claim 7 wherein said inner conduit of said first coaxial conduit receive a second nitrogen purge.

9. A containment vessel, comprising:

a bottle containing a chemical compound, said bottle having an inlet and an outlet;

an enclosure vessel having first and second assemblies connected together to form a cavity enclosing said bottle to provide an environmental seal of said bottle; and first and second coaxial conduits having an inner and an outer conduit, said inner conduits of said first and second coaxial conduits being coupled to said inlet and outlet of said bottle respectively for transporting said chemical compound, said outer conduits of said first and second coaxial conduits being connected to said cavity to purge any chemical compound escaping from said bottle into said cavity.

10. The containment vessel of claim 9 wherein said outer conduit of said first coaxial conduits receives a nitrogen gas purge.

11. The containment vessel of claim 10 wherein said enclosure vessel is made of polyethylene.

12. The containment vessel of claim 11 wherein said chemical compound is 1,1 dichloroethylene.

13. The containment vessel of claim 12 wherein said outer conduit of said first and second coaxial conduits receive a nitrogen purge from a first conduit and returns said nitrogen purge to a second conduit.

14. A chemical containment vessel, comprising:

a bottle containing 1,1 dichloroethylene, said bottle having an inlet and an outlet;

an enclosure vessel having first and second assemblies ,: connected together to form a cavity for housing said bottle and to provide an environmental seal of said bottle; and first and second coaxial conduits having an inner and an outer conduit, said inner conduits of said first and second coaxial conduits being coupled to said inlet and outlet of said bottle respectively for transporting said 1,1 dichloroethylene, said outer conduits of said first and second coaxial conduits being connected to said cavity to purge any chemical compound escaping from said bottle into said cavity.

15. The chemical containment vessel of claim 14 wherein said enclosure vessel is made of a chemically unreactive material.

16. The chemical containment vessel of claim 15 wherein said enclosure vessel is made of polyethylene.

17. The chemical containment vessel of claim 16 wherein said outer conduit of said first coaxial conduit receives a first nitrogen purge from a first conduit.

18. The chemical containment vessel of claim 17 wherein said outer conduit of said second coaxial conduit returns said first nitrogen purge to a second conduit.

19. The containment vessel of claim 18 wherein said inner conduit of said first coaxial conduit receive a second nitrogen purge.

* * * * *